US006406290B1

(12) United States Patent
Chon

(10) Patent No.: US 6,406,290 B1
(45) Date of Patent: Jun. 18, 2002

(54) CANDLE DECORATED WITH PAPER BEARING DESIGN

(76) Inventor: Chang-Wook Chon, 4600 Duke St. #826, Alexandria, VA (US) 22304

( * ) Notice: Subject to any disclaimer, the term of this patent is extended or adjusted under 35 U.S.C. 154(b) by 0 days.

(21) Appl. No.: 09/249,304

(22) Filed: Feb. 12, 1999

(51) Int. Cl.[7] ..... C11C 5/00

(52) U.S. Cl. ..... 431/289; 431/126; 156/215

(58) Field of Search ..... 431/126, 288, 431/289; 428/42.1, 40.5, 486, 488.1; 44/519; 156/308.2, 309.6, 213, 215, 309.9, 320, 322

(56) References Cited

U.S. PATENT DOCUMENTS

| | | | | | |
|---|---|---|---|---|---|
| 1,609,033 | A | | 11/1926 | Morse | 428/40.5 |
| 1,857,957 | A | * | 5/1932 | Hirschl | 431/289 |
| 2,426,462 | A | | 8/1947 | Marksberry et al. | 156/240 |
| 2,636,370 | A | | 4/1953 | Kramer | 431/126 |
| 2,645,870 | A | | 7/1953 | Smith et al. | 156/536 |
| 3,286,492 | A | * | 11/1966 | Frazier, Jr. | 431/126 |
| 3,516,904 | A | | 6/1970 | Klinker et al. | 215/365 |
| 3,839,119 | A | * | 10/1974 | Solomon | 431/126 |
| 3,974,014 | A | | 8/1976 | Meisner et al. | 156/240 |
| 4,030,959 | A | | 6/1977 | Meisner et al. | 156/457 |
| 4,035,937 | A | * | 7/1977 | Rosenfeld | 431/289 |
| 4,568,270 | A | * | 2/1986 | Marcus et al. | 431/126 |
| 4,696,640 | A | * | 9/1987 | Pitchford | 431/289 |
| 5,522,960 | A | * | 6/1996 | Rello et al. | 156/215 |
| 5,944,509 | A | * | 8/1999 | Masters et al. | 431/288 |
| 6,153,137 | A | * | 11/2000 | Youn et al. | 425/803 |

FOREIGN PATENT DOCUMENTS

| | | | |
|---|---|---|---|
| JP | H5-320689 | * 12/1993 | 431/289 |

OTHER PUBLICATIONS

Sterbenz, C. Pretty pillar candles make easy project [online] retrieved Dec. 14, 1999. Retrieved from the internet: <URL: http://www.detnews.com/homestyl/9802/28/byhand/by-hand.htm>.*

Wichegrod, L. Bougies à faire soi–même. Éditions S.A.E.P. (France), 2000. p. 46–47.*

Oates, L. Naturally Creative Candles. WI, Krause Publications, ©1997. p. 62–63.*

* cited by examiner

*Primary Examiner*—Sara Clarke
(74) *Attorney, Agent, or Firm*—Robert E. Bushnell, Esq.

(57) ABSTRACT

A candle decorated with a paper bearing design and a process for decorating the candle with the paper bearing a design are provided. The paper bearing a design wraps around the candle having a wick and a wax layer surrounding the wick. Heat and pressure are applied to the paper and the wax layer and the heat is transferred to the wax layer through the paper to melt or soften the wax layer. The melted or softened wax of the wax layer soaks into the paper and congeals, and then the congealed wax bonds with the paper and the wax layer. The design on the outer side of the paper remains elaborate and not damaged.

18 Claims, 6 Drawing Sheets

CANDLE DECORATED WITH PAPER BEARING DESIGN

BACKGROUND OF THE INVENTION

1. Technical Field

The present invention pertains to candles, generally, and more specifically, to decorated candles with paper bearing designs.

2. Background Art

Candles have been used in the past for ornamental purposes. Typically candles are decorated by putting a design onto the wax of the candle in a complicated process, or by using a paper including a design like a gravure printing process and removing the paper later after leaving the design on the wax of the candle. With these conventional methods, the design which remains on the the wax of the candle could be easily damaged during the process and even after the process. I have therefore found that it is impossible to correct or otherwise improve the conventional process in order to get a more perfect design on the wax of the candle.

U.S. Pat. No. 3,974,014 for a Method For Transferring Design Image To Wax Articles issued to M. U. Meisner, and U.S. Pat. No. 4,030,959 for an Apparatus For Transferring Design Image To Wax Articles issued to M. M. Meisner respectively disclose a process and an apparatus for transferring design images to wax articles. These references mention an apparatus and method for transferring design images to wax articles with a finishing station to make the candle, a cooling station, a drying station, a design image transfer station and a paper removal station. In the design image transfer station using the gravure printing process, preprinted, design-bearing waxed sheets are progressively wound about a corresponding candle body in a close conforming relationship. The tight wrapping is facilitated by virtue of the pressure applied through a carriage engaging the candle and by virtue of the heat at 125° F. applied through a hot water inlet of the transfer roller. This causes the inked design image printed on the waxed sheet to be transferred to the candle body. In the paper removal station, the paper is removed by the vacuum roller and discarded. I have noticed that this method has several critical defects and that the design could be damaged during the process for removing the paper from the candle with the vacuum roller.

Moreover, I have found that it is very inconvenient and defective process for forming an image on a candle because there is still something, for example the transferred sheet, to be removed from the design after the image was printed on the candle. Furthermore such an image decorated and obtained by using this conventional method cannot be clear and sharply defined, like a picture or the drawings on the paper.

U.S. Pat. No. 2,636,370 for a Method Of Decorating Candles And The Product Thereof issued to G. A. Kramer, discloses a method of decorating candles having a wick and a wax layer. A pattern holder which has a base, a rim around the top of the base and design elements is prepared. The base is placed upon the hot plate or heat source. A candle is brought into contact with the upper edge of the pattern holder or the upper edge of the design element, and rolled thereover, whereupon heated metal will melt the candle covering and cause the candle to be etched. In another embodiment of Kramer, melted wax is filled with the design element. The colored wax in melted condition is congealed in a film on the candle within the boundary defined by the groove which is etched out by the upper edge of the design element. In my opinion, this method uses only the simple design and the design transferred to the candle cannot be as clear as the design borne by the paper.

SUMMARY OF THE INVENTION

It is an object of the present invention to provide an improved process for decorating candles and an improved decorated candle.

It is another object to provide a decorated candle having at least one layer of wax and a process for decorating the candle with a design bearing paper.

It is an yet another object to provide a candle, with a wax layer wrapped with at least one paper bearing an elaborate design on the outer side of the paper, and the outer side of the wax layer contacting the inner side of the paper.

It is still another object to provide a candle wrapped with paper decorated by a design such as a drawing, figure, or picture, which is heated and pressed onto the outer surface of the candle, wherein heat is transferred through the paper to the wax layer, and the outer portion of wax layer will melt or become soft, and bond with the design bearing paper.

It is still yet another object to provide a candle surrounded by a design bearing paper, wherein melted wax soaks into the paper, and the melted wax in the wax layer and the soaked wax in the paper congeal and form bonds between the paper and the wax layer of the candle.

It is also an object to provide a process for making a candle decorated with at least one paper bearing an elaborated design without removing the paper involved in decorating process from the candle after the candle was decorated by imposition of the design on the wax layer of the candle.

These and other objects may be achieved by wrapping paper bearing a design around the exterior circumferential surface of the wax layer, heating and pressing the paper against the wax layer while some portion of the melted wax soaks into the paper, and then allowing the melted portion to cool. This process is very economic, effective and more convenient than conventional techniques.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
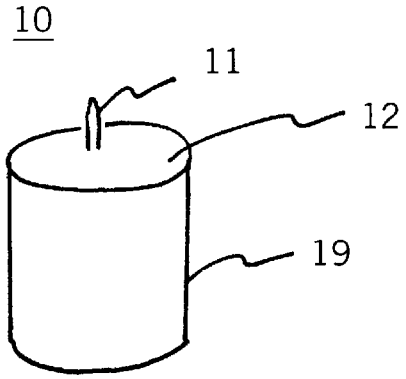
(Prior Art) Fig. 1
FIG. 1 is a perspective view of a conventional candle manufactured by a prior process.
Figure 2:
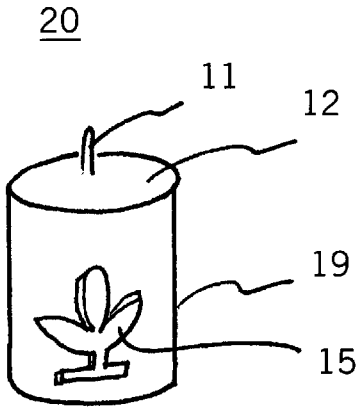
(Prior Art) Fig. 2
FIG. 2 is a perspective view of a conventional decorated candle manufactured by of the prior process.

FIG. 1 shows a conventional candle 10 which has a wick 11 and a wax layer 12 surrounding the wick 11. And FIG. 2 shows another conventional candle 20 decorated with a design 15 on a surface 19 of the wax layer 12. The design 15, however, requires a median material (not shown) to decorate the design 15 on the surface 19 of the wax layer 12; consequently, the material for design 15 is limited. The process is complicated and the design can not be made elaborate.

Figure 3:
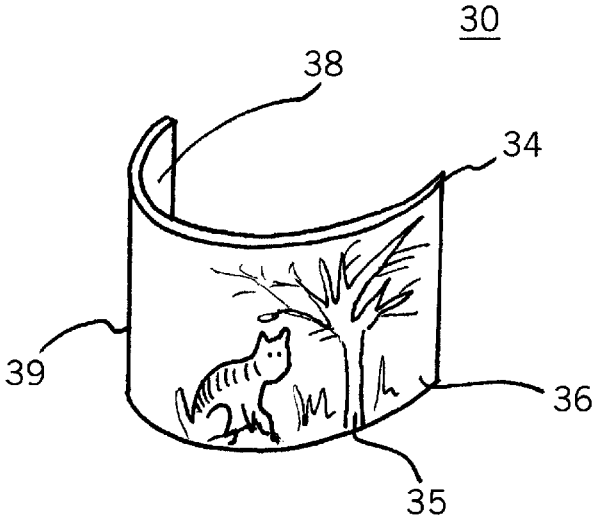
FIG. 3 is a perspective view of the paper bearing a design on its outer surface according to the practice of the present invention.

FIG. 3 illustrates a design bearing material 30 like a sheet of paper 36, having inner surface 38 and outer surface 39 and design 35 on the outer surface 39 of the paper 36 suitable for use in the practice of the present invention. The thickness 34 of the paper 36 is very thin, for example less than 2 mm. The melted or softened wax can easily soak into paper 36.

Figure 4:
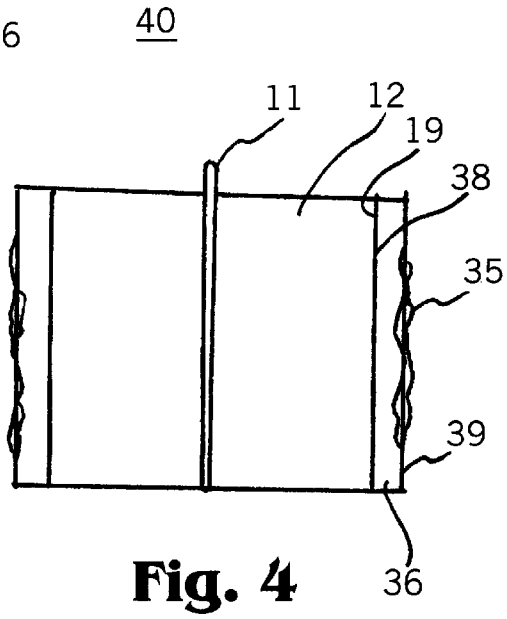
FIG. 4 is a cross sectional view of one embodiment showing the candle wrapped by the paper bearing a design according to the principles of the present invention.

FIG. 4 shows a cross-sectional view of decorated candle 40 ornamented according to the principles of the present invention. The paper 36 wraps around the exterior circumferential surface of the body of a conventional candle 10. The inner side 38 of the paper 36 contacts the outer surface 19 of the wax 12 of the candle 10. The beautiful and elaborate design 35 of the paper 36 is facing outward.

Figure 5:
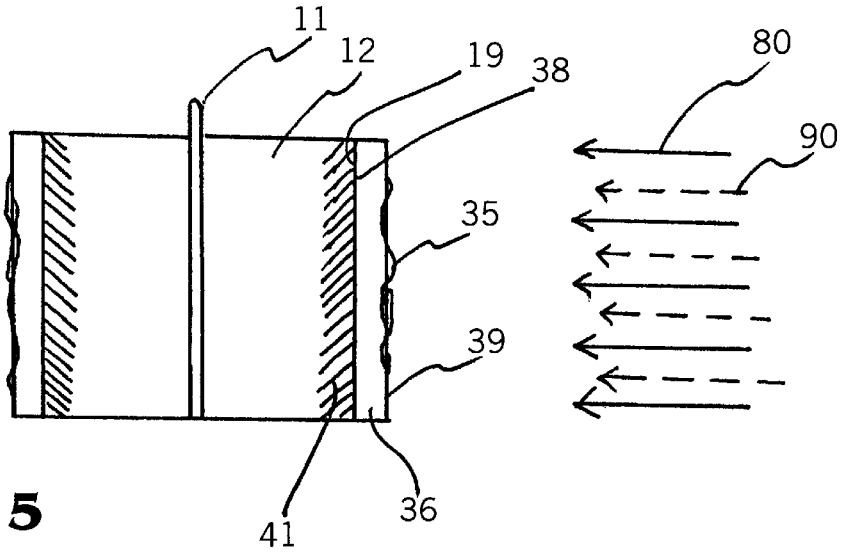
FIG. 5 is a cross sectional view of the above embodiment of the present invention showing the heat transferred and the melted portion of the wax layer of FIG. 4.

As indicated in FIG. 5, heat arrows 80 and pressure arrows 90 indicate the direction of application of heat and pressure to the exterior circumferential surface 39 of the paper 36. The application of heat 80 can be followed by the application of pressure 90. Or, alternatively, the heat 80 and pressure 90 can be applied simultaneously. For example, a roller or iron (not shown) equipped a heating element (not shown) can be used for both heating and pressing. The heat 80 is transferred through the paper 36 to the wax layer 12. Hatch marks 41 on the outer portion of the wax layer 12 shows where the wax is slightly melted or softened.

Figure 6:
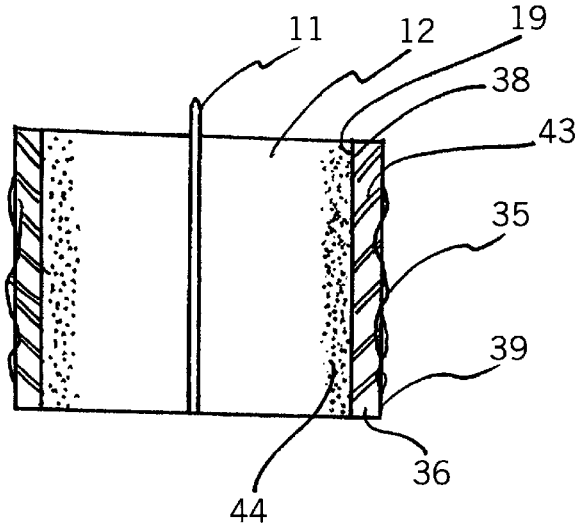
FIG. 6 is a cross sectional view of the present invention shown in FIGS. 4 and 5, showing the melted and cooled portion of the wax layer, and a portion of paper into which the melted wax of a portion of the wax layer has soaked.

FIG. 6 shows a finished product of the embodiment shown in FIGS. 4 and 5 according to the practice of this invention. Double hatch marks 43 on paper 36 represent the area that the melted or softened wax 41 of the wax layer 12 has soaked in to the paper 36 and has congealed. Dotted marks 44 represent the melted and congealed portion of wax layer 12. The regions indicated by the dotted marks 44 of the wax layer 12 and the double hatch marks 43 of the paper 36 can congeal simultaneously and bond with the paper 36 and wax layer 12.

Figure 7:
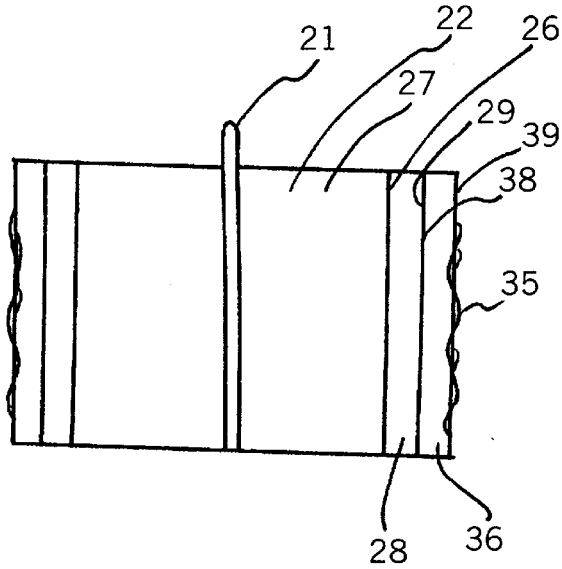
FIG. 7 is a cross sectional view of the another embodiment showing the candle having two wax layers wrapped by the paper bearing a design.
Figure 8:
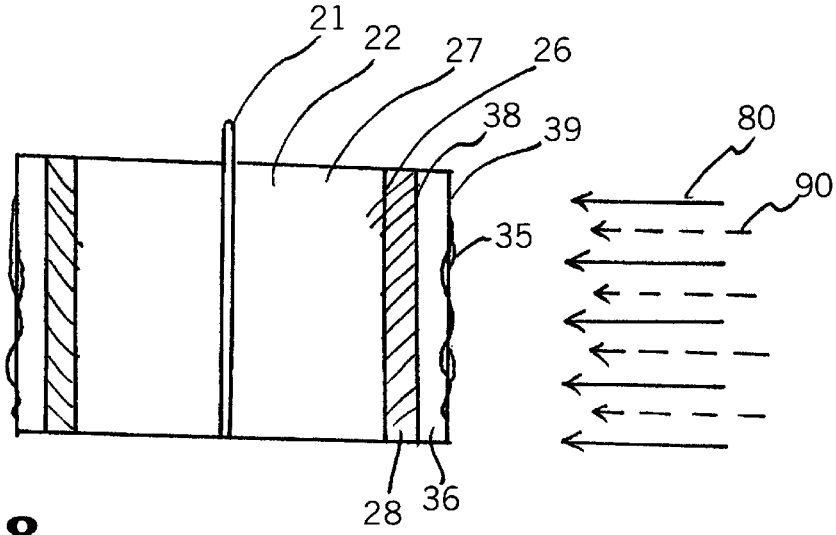
FIG. 8 is a cross sectional view of the present invention in FIG. 7, showing the application of the heat and the pressure transferred through the paper to a second layer of the candle.
Figure 9:
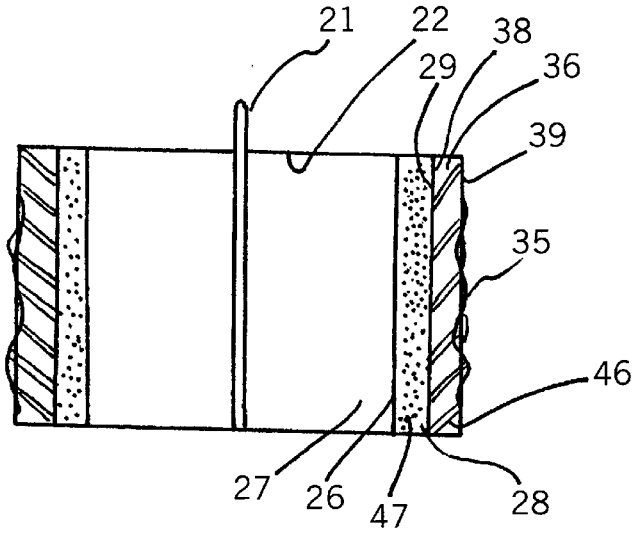
FIG. 9 is a cross sectional view of the present invention shown in FIGS. 7 and 8, showing a portion of paper into which the wax of a second portion of the candle soaked after the heat and the pressure were removed from the surface of the paper and the candle and the paper cooled.

FIG. 7 through FIG. 9 illustrate another embodiment of this invention for a candle having a wick 21, a first wax layer 27, a and second wax layer 28, and a boundary 26 between the first wax layer 27 and the second wax layer 28. The paper 36 wraps around the second wax layer 28 of perhaps a different composition or a different characteristic such as color. An inner surface 38 of the paper 36 contacts an outer surface 29 of the second wax layer 28 while the design 35 on an outer surface 39 of paper 36 is facing outwardly. In FIG. 8, heat 80 and pressure 90 are applied to the surface 39 of paper 36. The heat 80 and the pressure 90 are transferred through paper 36 to the wax layer 22, mostly to second layer 28. Depending on the thickness of the wax layer 28, the melting area can be extended to the first area 27. The hatch marks 45 represent the melting area of the wax. The melted or softened wax 45 soaks into paper 36 and congeals. Double hatch marks 46 represent the wax melted in wax layer 28, soaked into the paper 36 and congealed. Dotted marks 47 show the wax melted and congealed with the wax 46 soaked into paper 36.

Figure 10:
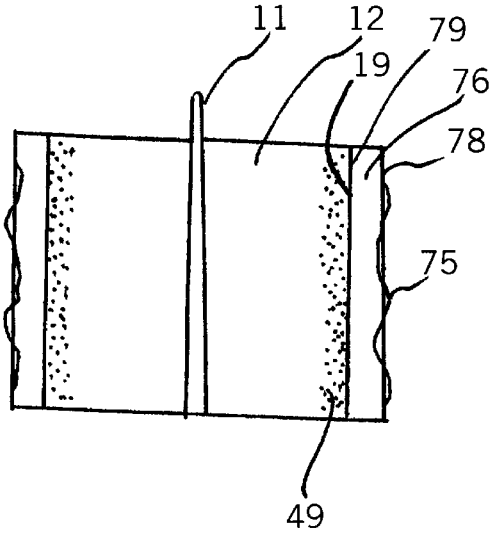
FIG. 10 is a cross sectional view of the another embodiment of the present invention showing the candle wrapped by the wax-proof paper, wherein the melted and cooled portion of the wax layer bonds the paper to the wax layer.

As shown in FIG. 10, wax-proof paper or plastic material 76 can be used for decorating a candle. The wax melted by the heat 8 cannot fully soak into the paper 76. Dotted marks 49 show that the wax of wax layer 12 melts and congeals. The wax in the region indicated by dotted marks 49 bonds with wax layer 12 and paper 76. A beautiful and elaborate design is decorated on the outer surface 78 of paper 76 while the inner surface 79 of paper 76 contacts the surface 19 of wax layer 12.

Figure 11:
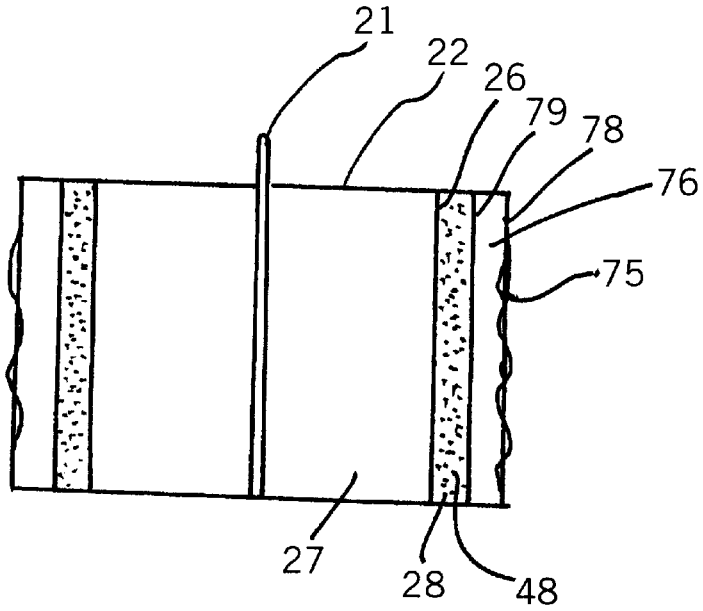
FIG. 11 is a cross sectional view of the another embodiment of the present invention showing the candle having an inner wax layer and an outer wax layer, with the outer wax layer melted and cooled so as to form a bond with the paper surrounding the outer wax layer.

FIG. 11 shows another embodiment of FIG. 10 for a candle with a wick 21, an inner wax layer 27, and an outer wax layer 28 and a boundary 26 between the inner wax layer 27 and the outer wax layer 28. The paper 76 wraps around the surface 78 of the outer wax layer 28. Depending on the thickness of the outer wax layer, the melted and congealed wax area shown by dotted marks 48 can be extended to the inner wax layer 27.

Figure 12:
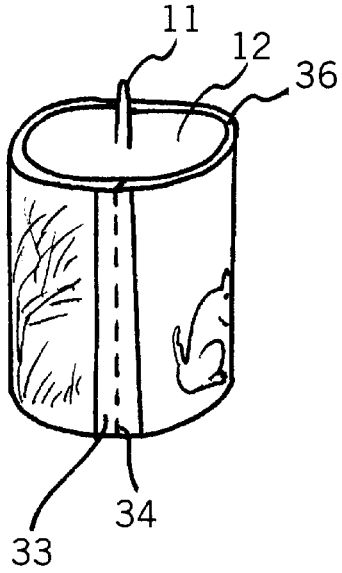
FIG. 12 is a perspective view of the another embodiment of the present invention
Figure 13:
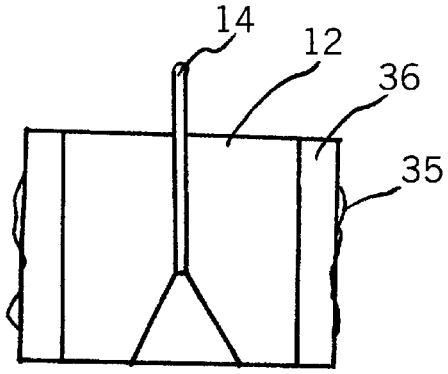
FIG. 13 is a cross sectional view of the another embodiment of the present invention

FIG. 12 shows a gluing area 33 on a joint 34 of opposite ends of the paper 36. FIG. 13 shows a short wick 14 in the wax layer 12. The upper end of wick 14 extends above the upper base surface of the candle, but the length of the wick 14 is shorter than the height of the paper 36.

Figure 14:
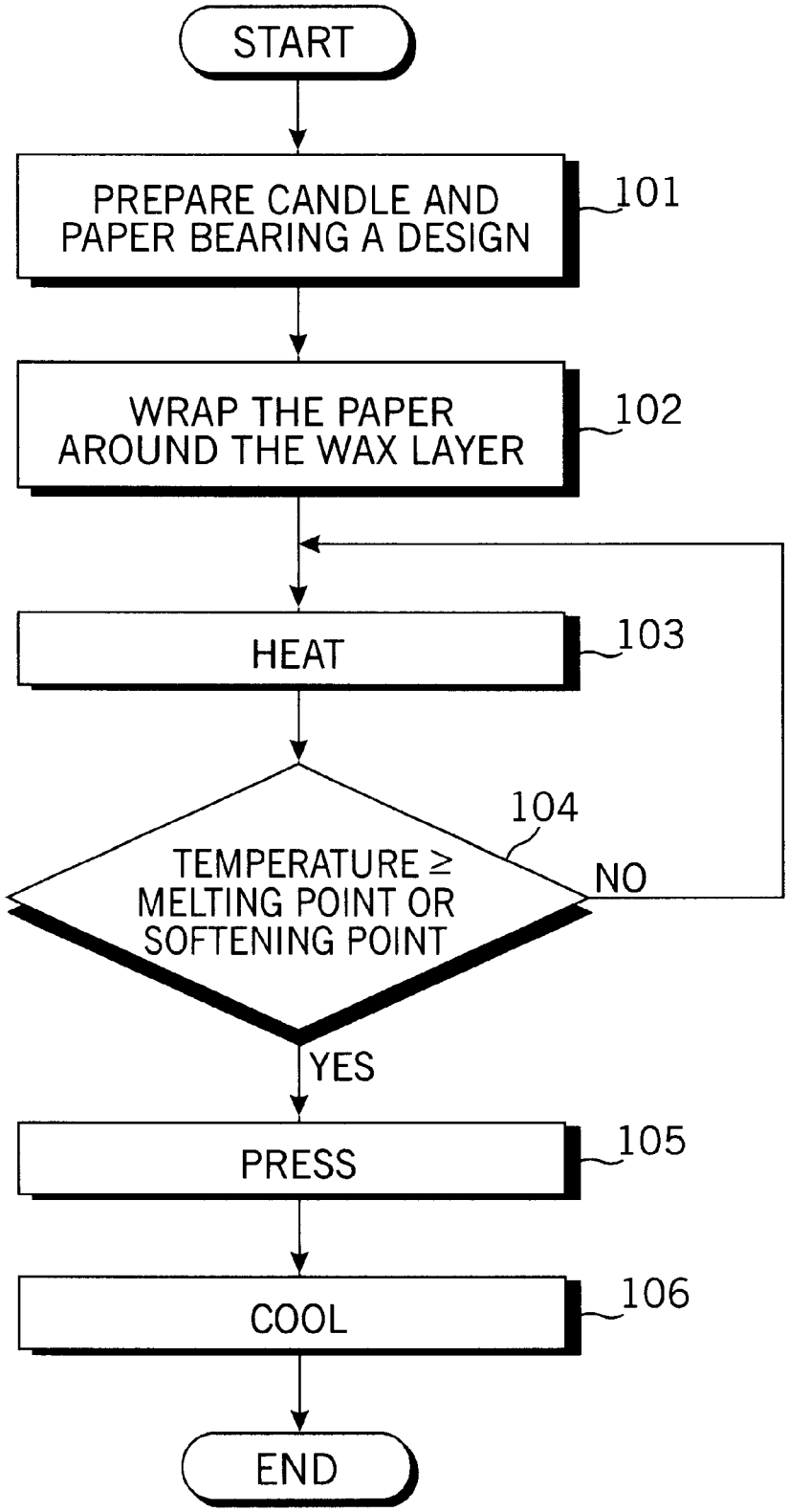
FIG. 14 is a flow chart showing the process for decorating the candle with the paper bearing a design according to one embodiment for the practice of this invention.

FIG. 14 shows how the process works to decorate a candle with the paper bearing a design. First step 101 means to prepare the candle 10 and the paper 36 or 76 bearing a design 35 or 75. In order to decorate the candle more beautifully and in more detail, more than two papers can be used.

Second step 102 follows the first step 101 and means that the paper 36 or 76 is wrapped around the outer perimetric (e.g., circumferential) surface 19 or 29 of wax layer 12 or 28. Third step 103 and fourth step 104 following second step 102, explains that the heat 80 affects the paper and is transferred through paper 36 or 76 to the wax layer until the wax layer is melted or softened. Fifth step 105 for pressing against the paper 36 or 76 and wax layer 12 or 28 can be either performed simultaneously with the step 103 and step 104, or after completion of step 103 and step 104. At this time, the melted wax soaks into the paper. Last step 106 for cooling the paper follows the previous step, and the melted wax that has soaked into the paper congeals to bond the paper to the wax layer.

Figure 15:
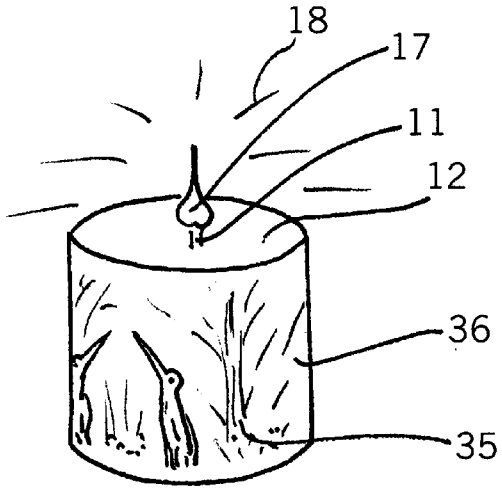
FIG. 15 is a perspective view of the decorated candle having the wick burning according to the principles of the present invention.
Figure 16:
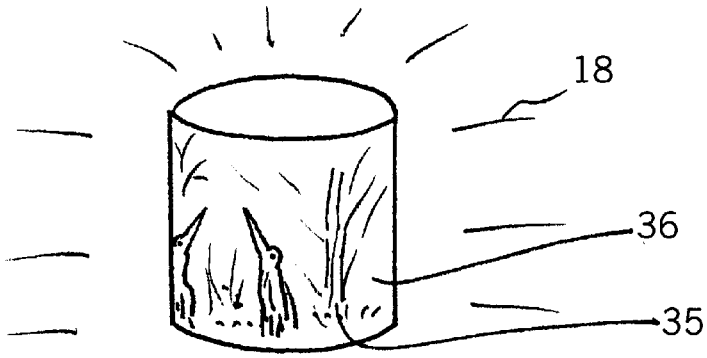
FIG. 16 is a perspective view of a partially burned decorated candle having the wick burning (not visible) inside the decorated paper according to the principles of the present invention.
Figure 17:
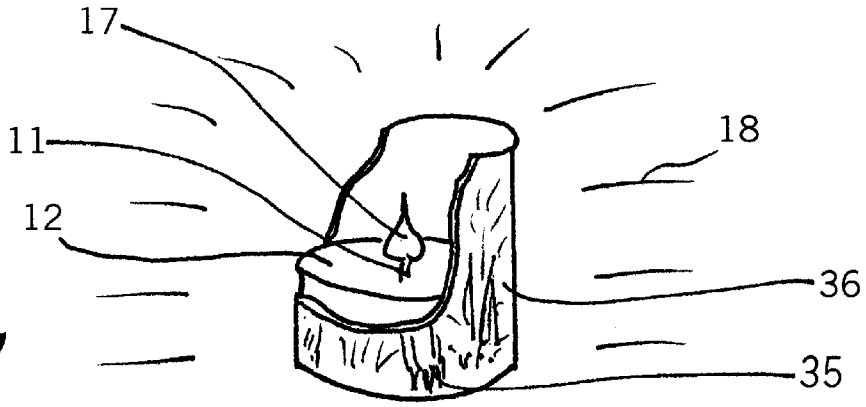
FIG. 17 is a perspective view of the decorated candle shown in FIG. 16 with the surrounding paper partially cut-away to show a shortened burning wick and a lowered wax layer.

FIG. 15 shows that the decorated candle 40 is beginning to burn with a flame 17. While the wick 11 is burning, the candlelight 18 from the flame 17 is brightening the circumference of the decorated candle 40. FIG. 16 shows candle 40 when the candle 40 is partially burned away. The wick 11 (not shown) is still burning but is hidden from view by the decorated paper 36. The paper 36 into which the wax of the wax layer 12 has soaked and congealed, is illuminated by candlelight 18. The candlelight 18 from the flame 17 (not shown) can pass through the paper 36 and brighten the circumference of the candle 40 causing the design 35 of the paper 36 to be visible. People sitting around the candle 40 can enjoy the design and the candlelight while candle 40 is burning. In FIG. 17, the paper 36 is partially cut away to show the inside of the paper 36 of FIG. 16 in relation to the still burning wick 11. The wick 11 surrounded by the paper 36 is burning and the height of the wax layer 12 is lowered by burning the candle 40.

According to the principles of this invention, an elaborate and detailed design can be decorate the wax layer of the candle without the process of removing the median material. While this invention has been described in connection with what is presently considered to be the most practical and the disclosed embodiments, but it is to be understood that the invention is not limited to the disclosed embodiments, but, on the contrary, is intended to cover various modifications and equivalent arrangements included within the sprit and scope of the amended claims.

What is claimed is:

1. A decorated candle, comprising:

a wick;

a wax layer surrounding said wick;

a translucent paper bearing an ornamental design on a first major surface, said paper having a second and opposite major surface wrapped completely circumferentially around and permanently bonded directly to an entire exterior circumferential surface of said wax layer without any additional wax material applied to said paper;

a portion of said exterior circumferential surface of said wax layer melted by heat transferred through said paper, soaked into said paper via said second major surface in order to permanently bond said paper directly to said wax layer with said ornamental design being viewable from all sides of the candle; and a height of said wax layer being less than a height of said paper with said height of said paper remaining relatively static as said candle burns.

2. The candle of claim 1, further comprised of a bond formed when heat is transferred to an outer portion of said wax layer through said paper until said outer portion of said wax layer melts or is softened by said heat.

3. The candle of claim 2, further comprised of said bond being formed by said melted portion of said wax layer soaking into said paper.

4. The candle of claim 3, wherein said wax layer congeals with said melted portion of said wax layer to form congealed wax.

5. The candle of claim 4, wherein said congealed wax bonds with said paper and said wax layer.

6. The candle of the claim 2, wherein said wax layer congeals with said melted portion of said wax layer to form congealed wax.

7. The candle of claim 1, wherein said wax layer is comprised of a first layer and second layer, and said second major surface of said paper wraps around said second layer.

8. The candle of claim 7, further comprised of a melted layer formed as said second layer melts by heat transferred through said paper and said melted layer of said second layer soaks into said paper.

9. The candle of the claim 1, wherein said paper transmits candlelight of a flame of said wick and said candlelight brightens the circumference of said candle.

10. A process for decorating a candle, comprising the steps of:

forming a candle with a wick and a layer of wax surrounding said wick;

wrapping a translucent paper bearing an ornamental design on a first major surface, with a second and opposite major surface of said paper wrapped completely around an entire exterior circumferential surface of said candle after said candle has been formed;

allowing heat to be transferred to said layer of wax through said paper to melt an outer surface of said wax layer and soak into said paper, with said outer surface of said wax forming a bond between said layer of wax and said paper via said second major surface without adding any additional wax material to said paper, with said ornamental design being visible from all sides of the candle; and allowing a height of said wax layer to lower while burning said candle and the height of said paper remains the same as said candle burns.

11. The process of claim 10, further comprising the step of applying pressure against said paper and said wax layer.

12. The process of claim 11, further comprised of simultaneously applying heating and pressing to said paper while said paper remains wrapped around said candle.

13. The process of claim 11, further comprising the steps of:

allowing said melted wax to congeal and bond with said paper and an inner portion of said wax layer;

allowing a height of said wax layer to lower while burning said candle with a height of said paper remaining the same as said candle burns; and allowing candlelight of a flame of said wick to transmit through said paper and brighten the circumference of said candle.

14. The process of claim 11, further comprising the step of allowing said melted wax from said outer portion of said wax layer to soak into said paper.

15. The process of claim 14, further comprising the step of allowing said wax soaked into paper to congeal and bond with said paper and said wax layer.

16. The process of claim 15, further comprising the step of allowing height of said wax layer to lower while burning said candle and the height of said paper remains the same as said candle burns.

17. The process of claim 11, further comprising the step of allowing said melted wax to congeal and bond with said paper and an inner portion of said wax layer.

18. A decorated candle, comprising:

a wick;

a wax layer surrounding said wick;

a translucent paper bearing an ornamental design on a first major surface, said paper having a second and opposite major surface wrapped completely circumferentially around and permanently bonded directly to an exterior circumferential surface of said wax layer without any additional wax material applied to said paper;

a bond formed between said exterior circumferential surface of said wax layer melted by heat transferred through said paper via said second major surface, soaking into said paper and forming said bond between said paper and said wax layer with said ornamental design being viewable from all sides of the candle; and a difference in height between said wax layer and said paper occurring with a height of said wax layer being less than a height of said paper and said height of said paper remaining relatively static as said candle burns.

* * * * *